US005996187A

United States Patent [19]

Tanaka et al.

[11] Patent Number: 5,996,187

[45] Date of Patent: Dec. 7, 1999

[54] SLIDER FOR ENGAGING FASTENERS PROVIDED

[75] Inventors: Mikio Tanaka, Tenri; Akira Ishizaki, Kashiba, both of Japan

[73] Assignees: Sun A Kaken Co., Ltd.; Piaru Corporation, both of Japan

[21] Appl. No.: 09/193,685

[22] Filed: Nov. 18, 1998

[30] Foreign Application Priority Data

Dec. 19, 1997 [JP] Japan ..... 9-365302

[51] Int. Cl.[6] ..... A44B 19/00; B65D 33/00

[52] U.S. Cl. ..... 24/399; 24/400; 24/587

[58] Field of Search ..... 24/399, 400, 587, 24/576, 543, 30.5 P

[56] References Cited

U.S. PATENT DOCUMENTS

| | | | |
|---|---|---|---|
| 3,234,614 | 2/1966 | Plummer | 24/400 |
| 4,514,882 | 5/1985 | Lavielle | 24/30.5 P |
| 5,067,208 | 11/1991 | Herrington, Jr. et al. | 24/399 |
| 5,070,583 | 12/1991 | Herrington | 24/400 |
| 5,283,932 | 2/1994 | Richardson et al. | 24/400 |
| 5,638,586 | 6/1997 | Malin et al. | 24/587 |

FOREIGN PATENT DOCUMENTS

| | | |
|---|---|---|
| 5-137607 | 6/1993 | Japan . |
| 6-77518 | 11/1994 | Japan . |
| 11-59740 | 3/1999 | Japan . |
| 11-89613 | 4/1999 | Japan . |

*Primary Examiner*—Victor N. Sakran
*Attorney, Agent, or Firm*—Larson & Taylor

[57] ABSTRACT

A slider 1 for engaging at least two fasteners provided inside of opposed edge portions of a bag defining an opening. The fasteners each includes a male fastener member strip and provided on the inner surface of one of the edge portions and a female fastener member strip and provided on the inner surface of the other edge portion in opposed relation with the male fastener member. The slider 1 includes a slider body 2 and a clamp member 3 for the slider body 3. The slider body 2 includes two opposite plates 2*a*, 2*a* interconnected by a base portion 4 and foldable over each other at the base portion. At least one of plates 2*a* is formed in an inner surface thereof with at least two grooves 5, 5 arranged in parallel for fitting therein respective fastener portions of the bag for the plates 5, 5 to press and engage the fasteners from outside. A tonguelike stopper 6 is positioned inwardly of the plates 2*a*, 2*a* and extends from base portion 4 to a position closer to the base portion 4 than the groove 5 immediately adjacent to the base portion when the plates 2*a*, 2*a* are folded over each other.

4 Claims, 7 Drawing Sheets

SLIDER FOR ENGAGING FASTENERS PROVIDED

BACKGROUND OF THE INVENTION

The present invention relates to improvements in sliders for engaging fasteners provided at the opening portions of bags, and more particularly to improvements in a slider for engaging at least two fasteners provided inside of opposed edge portions of an article- enclosing bag defining an opening thereof, the fasteners each comprising a male fastener member extending on the inner surface of one of the edge portion and a female fastener member extending on the inner surface of the other edge portion and opposed to the male fastener member, the slider being improved so that the fasteners can be readily and reliably engaged by a single sliding movement of the slider as fitted around the opening-defining edge portions of the bag in clamping engagement therewith.

Sliders have been proposed for engaging fasteners of the type mentioned. For example, fastener engaging sliders are known which are disposed in Unexamined Japanese Utility Model Publication No. 77518/1994, and Unexamined Japanese Patent Publication No. 137607/1993.

The disclosed sliders are each fitted around the opening portion of a bag provided with fasteners, and have the advantage that the fasteners can be easily and reliably engaged to close the bag opening portion merely by slidingly moving the slider once along the opening edge of the bag, but have the following drawbacks.

The slider disclosed in the former publication is very likely to slip off from the bag beyond the side edge portion of the bag when completely moved slidingly, and is accordingly likely to become lost or requires the cumbersome procedure of fitting the slider accurately around the opening portion of the bag every time the slider becomes released from the bag.

In the case of the slider disclosed in the latter publication, the fastener end is provided with a clamp or like slipping-off preventing member for precluding the slider from slipping off the bag upon completion of sliding movement, whereas provision of such preventing member at the opening portion of the bag is not desirable because of an increased number of steps required for making bags and also entails the problem of impairing the appearance of the bag.

SUMMARY OF THE INVENTION

An object of the invention, which has been accomplished to overcome the foregoing problems, is to provide a slider for easily and reliably engaging at least two fasteners provided inside of opposed edge portions of a bag defining an opening thereof, the fasteners each comprising a male fastener member extending on the inner surface of one of the edge portions and a female fastener member extending on the inner surface of the other edge portion in opposed relation with the male fastener member, the slider having the advantage of being reliably precluded from slipping off from the end of the bag opening edge portion without the necessity of providing a preventive member such as a clamp at the fastener end.

The present invention provides a slider for engaging fasteners provided at an opening portion of a bag, the fasteners being at least two in number and provided inside of opposed edge portions of the bag defining an opening, the fasteners each comprising a male fastener member in the form of a strip and provided on an inner surface of one of the edge portions and a female fastener member in the form of a strip and provided on an inner surface of the other edge portion in opposed relation with the male fastener member, the slider comprising a slider body and a clamp member for the slider body, the slider body comprising two opposite plates interconnected by a base portion and foldable over each other at the base portion, at least one of plates being formed in an inner surface thereof with at least two grooves arranged in parallel for fitting therein respective fastener portions of the bag for the plates to press and engage the fasteners from outside, a tonguelike stopper being positioned inwardly of the plates and extending from the base portion to a position closer to the base portion than the groove immediately adjacent to the base portion when the plates are folded over each other, the slider body being holdable by the clamp member in nipping engagement therewith and thereby prevented from slipping off the bag when attached to the opening-defining edge portions of the bag with the plates thereof folded over each other.

To use the slider thus constructed, the opening-defining opposed edge portions of the bag are closed with the slider body folded generally in two, with the two fastener portions of the bag fitted in the respective grooves, the clamp member is fitted over the slider body in nipping engagement therewith to attach the slider to the opening edge portions of the bag, and the slider is thereafter slidingly moved to engage the male fastener members with the respective female fastener members. Thus, the slider has the advantage that the opening portion of the bag can be smoothly, reliably and efficiently sealed off in repetition.

The free end of the stopper is positioned closer to the base portion than the groove immediately adjacent to the base portion and therefore unlikely to interfere with the sliding movement of the slider. When the stopper comes into contact with the end of the bag opening portion, the contact enables the user to reliably recognize that the opening is completely closed, thus eliminating the need to visually perceive the closed state. Further when the bag has been completely closed by the slider, the stopper effectively prevents the slider from slipping off the bag laterally thereof, hence the advantage of obviating the likelihood of the slider becoming lost or eliminating the cumbersome procedure of attaching the slider to the bag opening portion again.

The slider body in nipping engagement with the opening edge portions of the bag is reliably held by the clamp member from outside and is therefore unlikely to slip off from the bag opening portion unless the clamp member is forcibly removed. The slider has the advantage of retaining these effects over a prolonged period of time.

DESCRIPTION OF THE PREFERRED EMBODIMENT

The preferred embodiment of the present invention will be described below with reference to the accompanying drawings. The embodiment is a slider 1 for engaging fasteners F provided at an opening portion of a bag B. The slider 1 comprises a slider body 2 and a clamp member 3 for the slider body 2. These components are prepared from a rigid plastic by molding and have the following constructions.

Figure 1:
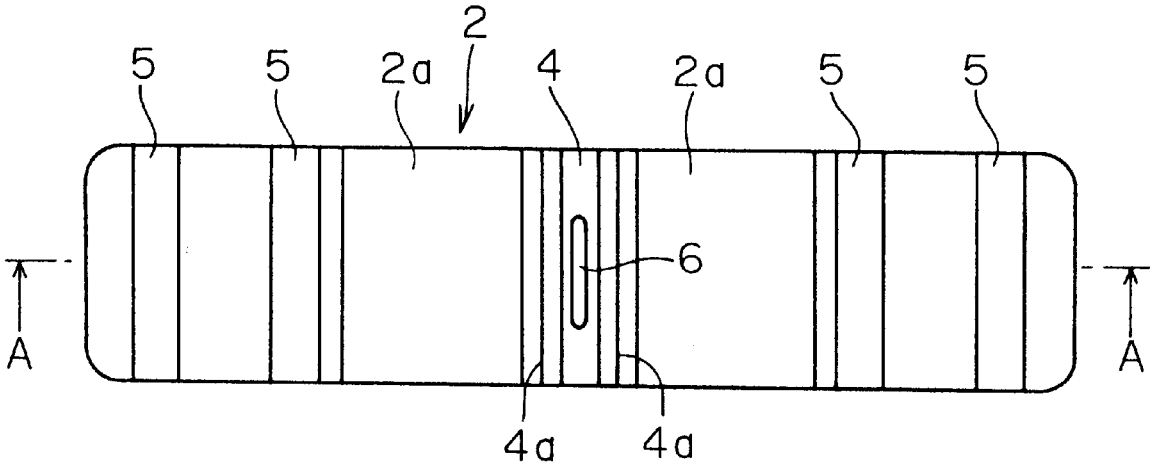
FIG. 1 is a plan view showing the inner side of the body of a slider as the preferred embodiment of the invention.
Figure 3:
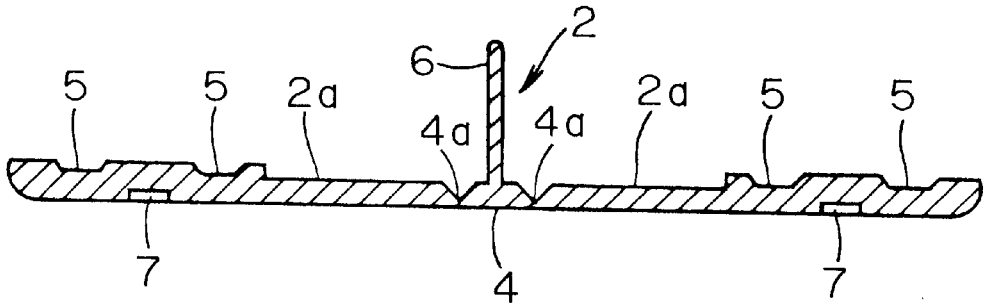
FIG. 3 is a view in section taken along the line A—A in FIG. 1.
Figure 4:
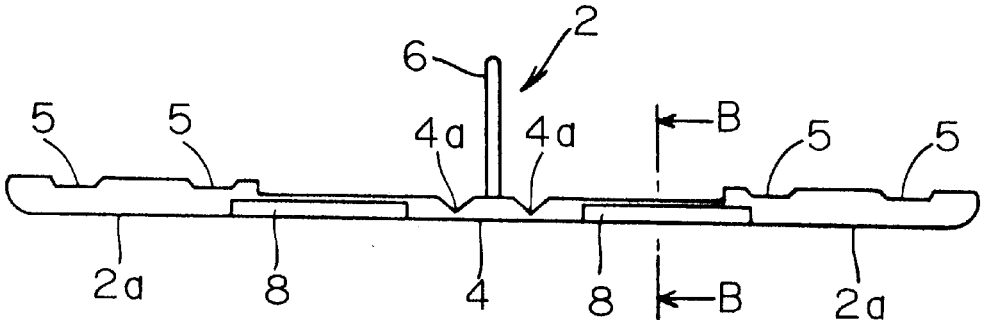
FIG. 4 is a side elevation of the slider body.
Figure 5:
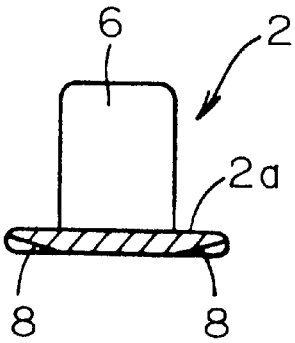
FIG. 5 is a view in section taken along the line B—B in FIG. 4.

With reference to FIGS. 1, 3 and 4, the slider body 2 comprises opposite rectangular plates 2*a*, 2*a* of the same size which are interconnected by an intermediate base portion 4 and foldable over each other at thin wall parts 4*a*, 4*a* of the base portion 4. Each of these plates 2*a*, 2*a* is formed in its inner surface (i.e., the surface shown in FIG. 1) with two grooves 5, 5 extending transversely of the plate and arranged in parallel as spaced apart by a suitable distance. The grooves 5, 5 are left open at their opposite ends. As will be described in detail later, the bag B for use with the slider 1 has opposed edge portions defining an opening B1 of the bag at one end thereof, and two fasteners F provided on the edge portions inside thereof and arranged in parallel to each other. When the plates 2*a*, 2*a* are folded over each other, the two fastener portions of the bag are fitted in the respective pairs of opposed grooves 5, as held between the opposed plates 2*a*, 2*a* from outside.

The slider body 2 has on its inner surface a tonguelike stopper 6 projecting from the midportion of the base portion 4. The stopper 6 has such a length that when the slider body 2 is folded generally in two, the free end of the stopper 6 is positioned closer to the base portion 4 than the inner pair of opposed grooves 5 immediately adjacent to the base portion 4.

Figure 2:
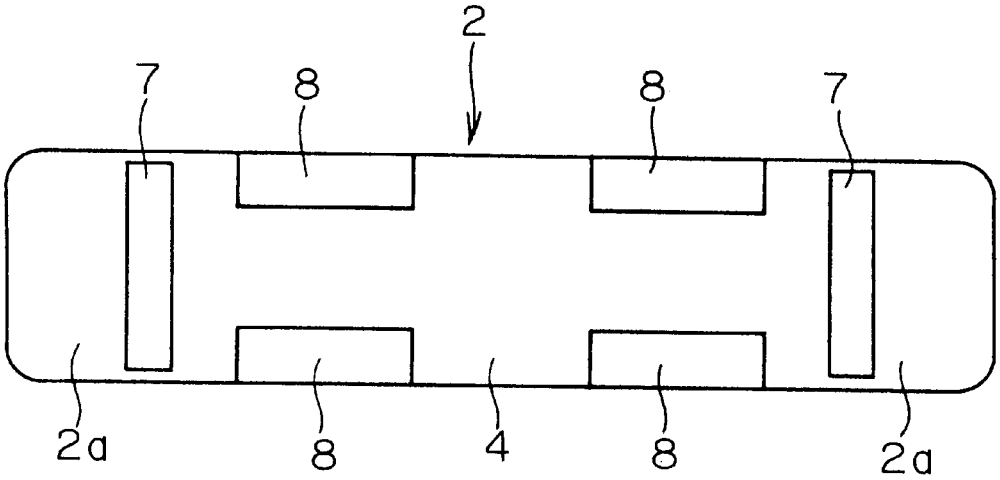
FIG. 2 is a plan view showing the outer side of the slider body.
Figure 6:
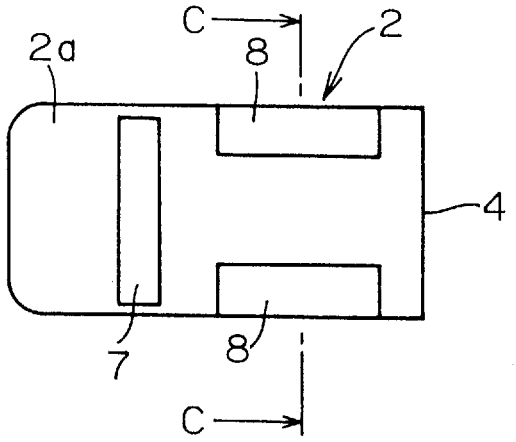
FIG. 6 is a plan view of the slider body as folded in two.
Figure 7:
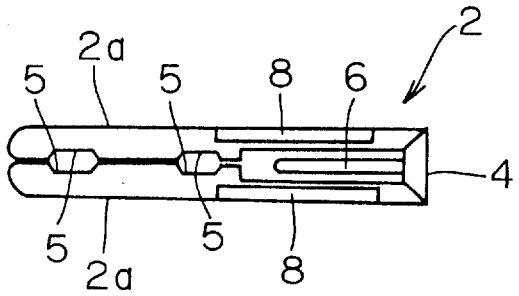
FIG. 7 is a side elevation of FIG. 6.
Figure 8:
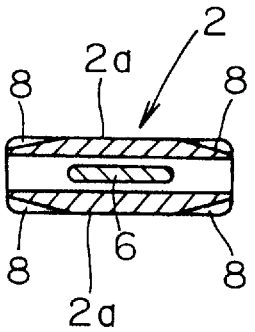
FIG. 8 is a view in section taken along the line C—C in FIG. 6.

As shown in FIGS. 2, 3 and 6, each plate 2*a* of the slider body 2 is formed in its outer surface with a shallow rectangular furrow 7 elongated transversely of the plate and positioned close to the free end of the plate. Between the furrow 7 and the base portion 4, the outer surface of the plate 2*a* includes at its opposite lateral sides tapered faces 8, 8 slanting outward as seen in FIGS. 2 and 4 to 8.

Figure 9:
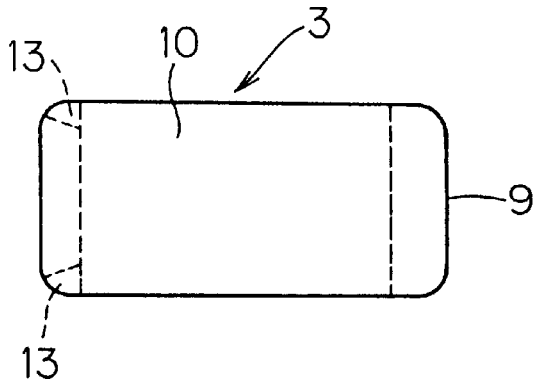
FIG. 9 is a plan view of a clamp member for the slider body.
Figure 10:
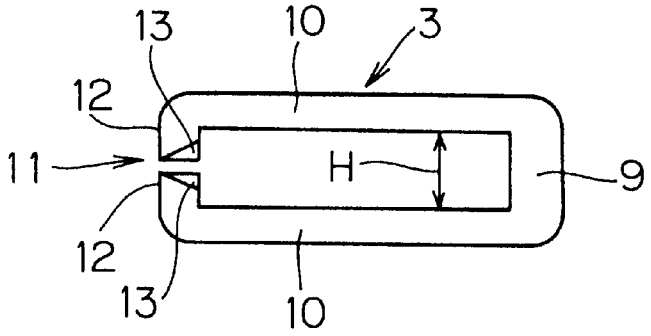
FIG. 10 is a side elevation of FIG. 9.
Figure 11:
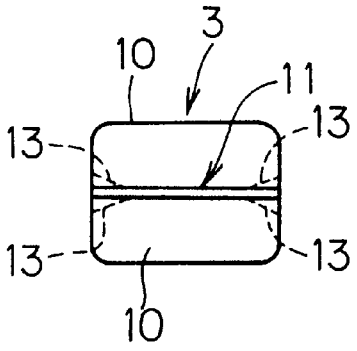
FIG. 11 is a front view of FIG. 9.

With reference to FIGS. 9 to 11, the clamp member 3 for the slider body 2 comprises rectangular nipping pieces 10, 10 extending from a base portion 9 integrally therewith and opposed to each other as vertically spaced apart by a required distance H. The upper and lower nipping pieces 10, 10 have downward and upward engaging projections 12, 12, respectively, at their free ends defining an open end 11 of the clamp member 3. The lower end of the downward projection 12 and the upper end of the upward projection 12 are formed at each lateral side of the clamp member 3 with a downwardly outward slanting triangular face 13 and an upwardly outward slanting triangular face 13, respectively.

The slider body 2 and the clamp member 3 thus constructed provide the slider 1 of the invention for engaging the two fasteners F provided at the opening portion of the bag B.

Figure 14:
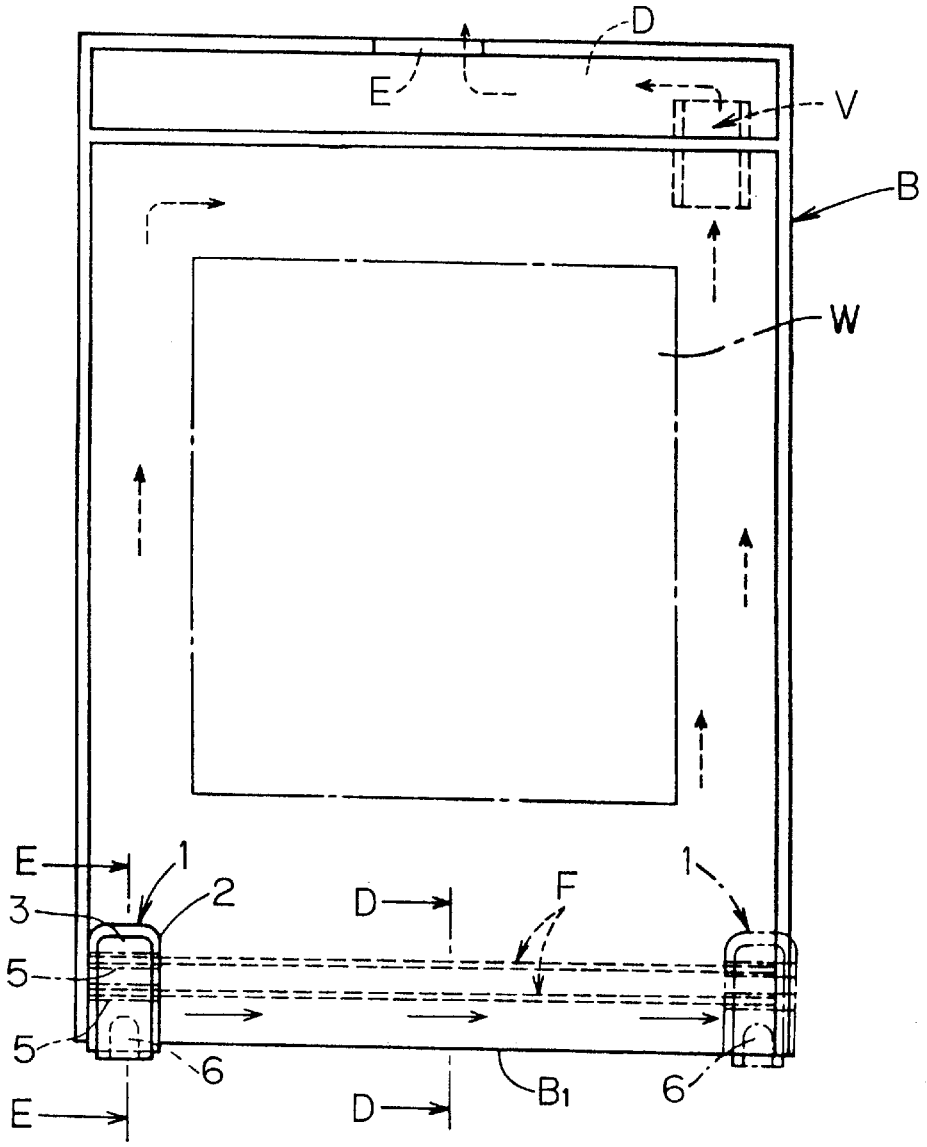
FIG. 14 is a plan view showing the slider of the invention as fitted around opening-defining edge portions of a bag.
Figure 15:
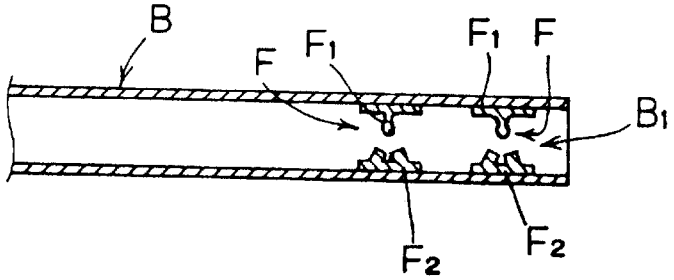
FIG. 15 is a view in section taken along the line D—D in FIG. 14.

FIGS. 14 and 15 show as an example, the bag B for which the slider 1 is used as attached thereto. The bag B is made of a plastic film and has a flat check valve V at the bottom end of the bag for releasing a fluid for use in enclosing clothes, bedclothes or other compressible articles as sealed off. For sealing the bag B, the bag has two fasteners F provided inside the opposed edge portions defining the opening B1 and each comprising a male fastener member F1 in the form of a plastic tape and provided on the inner surface of one of the edge portions, and a female fastener member F2 in the form of a plastic tape and provided on the inner surface of the other side edge portion in opposed relation with the member F1. The slider 1 is used for engaging the fasteners F to seal off the opening B1 of the bag B.

The fastener engaging slider 1 of the foregoing construction is used, for example, in the following manner to produce the effect to be described below.

Figure 16:
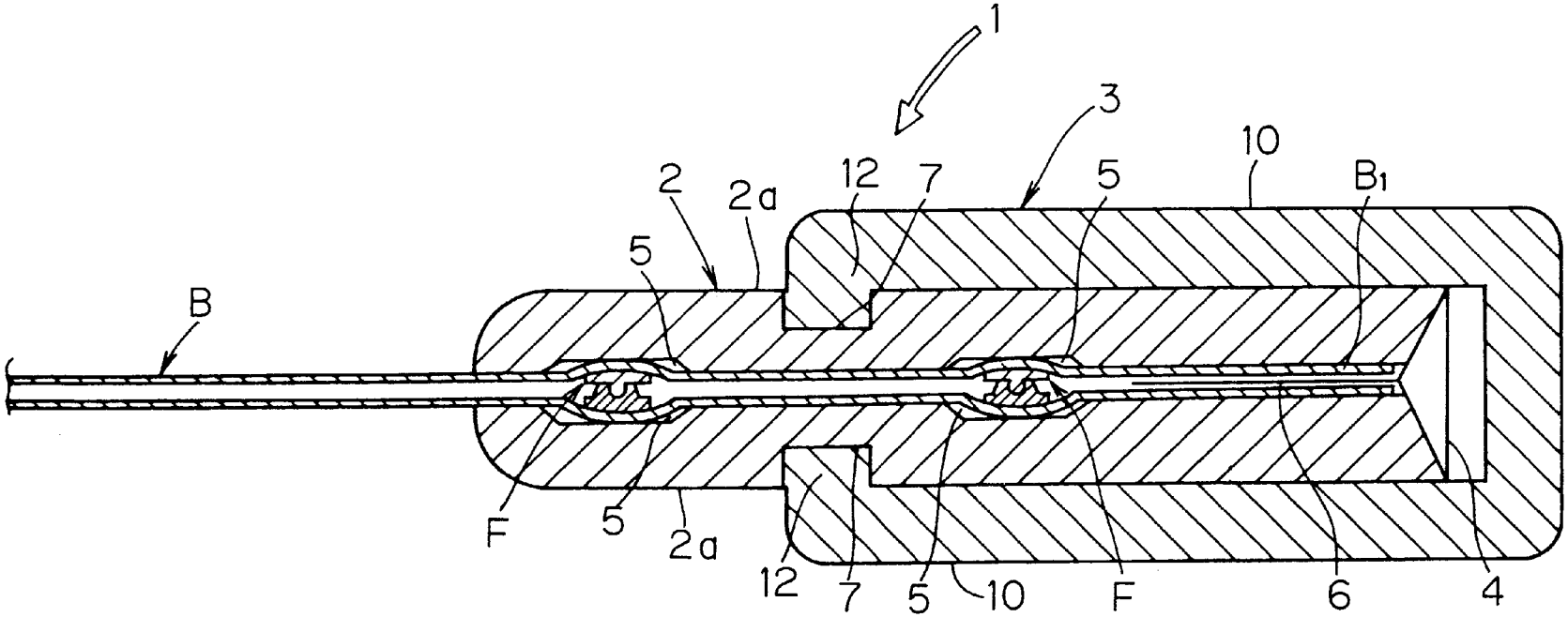
FIG. 16 is an enlarged view in section taken along the line E—E in FIG. 14.

First, clothes, bedclothes or like compressible article W is placed into the bag B through the opening B1, and the slider body 2 is then folded generally in two by fingers at the thin wall parts 4*a*, 4*a* of the base portion 4, with the stopper 6 inserted in one corner of the opening B1 of the bag B between the opposed side edge portions thereof. As shown on an enlarged scale in FIG. 16, the two fastener portions of the bag B are fitted into the respective pairs of opposed grooves 5, the grooves being formed in the inner surfaces of the plates 2*a*, 2*a* symmetrically with respect to the base portion 4.

The plates 2*a*, 2*a* are thereafter pressed with fingers to close the slider body 2. As shown schematically in FIG. 12, the clamp member 3 is fitted to one corner of the base end of the slider body 2 in this state utilizing the spacing H between the nipping pieces 10, 10 of the clamp member 3, and turned in the direction of arrow A1 in the drawing. The slider body 2 as folded has outwardly slanting tapered faces 8, 8 included in respective outer surfaces thereof, and the opposed ends of engaging projections 12, 12 are formed at each lateral side of the clamp member 3 with the slanting triangular faces 13, 13, respectively, so that the clamp member 3 is smoothly slidable on the opposite outer surfaces of the folded slider body 2 and fitted to the member 3 in alignment therewith.

Figure 12:
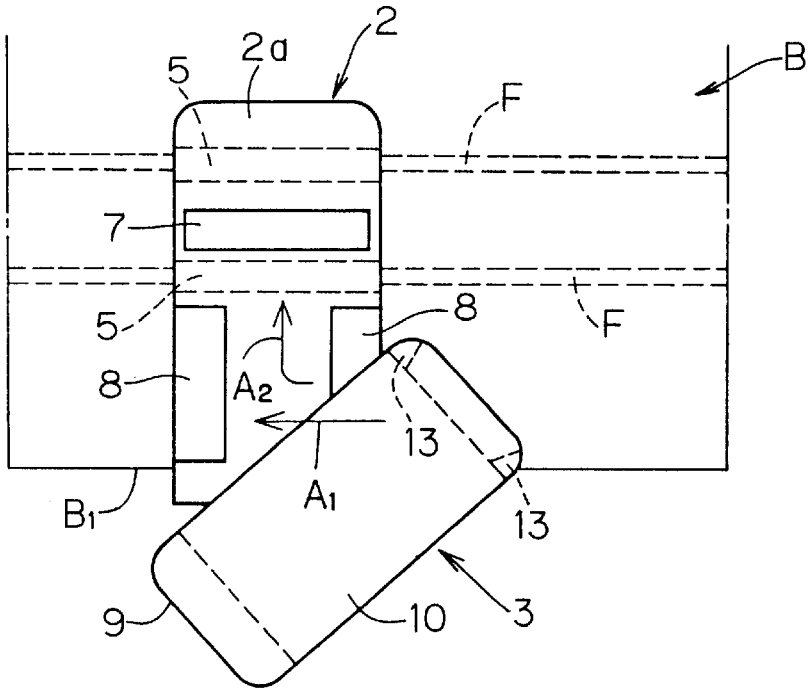
FIG. 12 is a diagram for illustrating how to fit the clamp member around the slider body.
Figure 13:
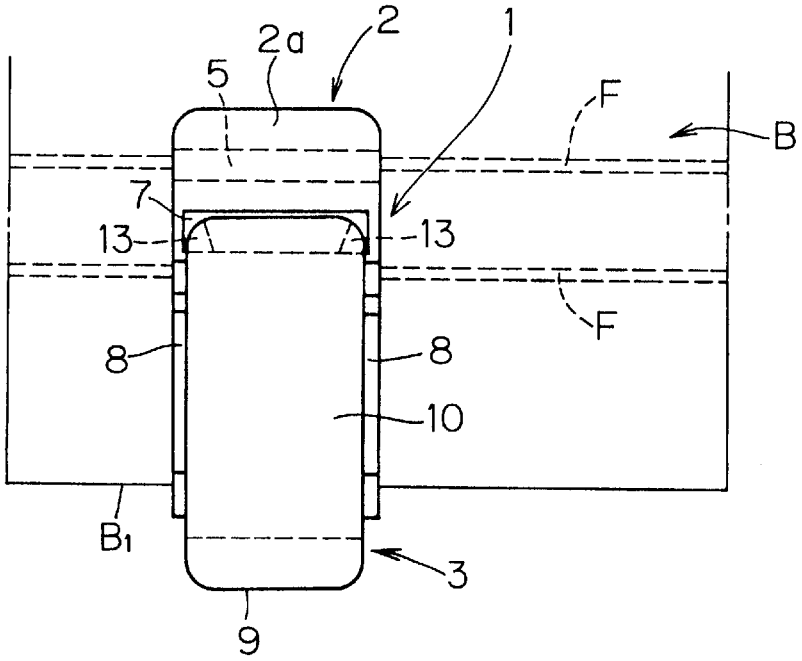
FIG. 13 is a plan view showing the clamp member as fitted around and engaged with the slider body.

Next, when the clamp member 3 is forced straight toward the bottom of the bag in the direction of arrow A2 in FIG. 12, the opposed upper and lower engaging projections 12, 12 provided at the free ends of the clamp member 3 engage in the respective furrows 7, 7 positioned close to the free ends of the plates 2*a*, 2*a* of the slider body 2, with the result that the slider body 2 can be effectively clamped by the resilience of the member 3 which is molded of rigid plastic. The slider 1 comprising the slider body 2 and the clamp member 3 which are attached to the opening-defining edge portions of the closed bag B is reliably held attached to the edge portions without the likelihood of slipping off while being slidable along the opening portion B1.

With reference to FIG. 14, the slider 1 as positioned at one corner of the opening portion of the bag B is subsequently moved slidingly to the other corner as indicated by an arrow, whereby male fastener members F1 of the two fasteners F are smoothly and reliably engaged with the respective female fastener members F2 opposed thereto since the fastener portions of the bag B are held between the respective pairs of grooved portions 5 of the slider body 2 as folded, whereby the opening B1 is effectively closed or sealed off.

Since the stopper 6 of the slider 1 is positioned between the opening-defining edge portions of the bag B and located closer to the opening extremity of the bag B than the fasteners F, the stopper 6 will not interfere with the sliding movement of the slider 1. The bag B has bonded lateral side edges, so that the stopper 6 comes into contact with one of the side edges on completion of the sliding movement and is prevented from further movement. This results in the advantage that the contact enables the user to recognize the completion of the opening closing operation without visually perceiving the closed state, while precluding the slider 1 from slipping off from the bag B sideways. The slider body 2 in nipping engagement with the opening-defining edge portions of the bag B is reliably gripped by the clamp member 3 and is therefore prevented from slipping off from the opening portion B1 unless the clamp member 3 is forcibly removed.

Next, the closed bag B is compressed, releasing air from inside through the check valve V and then through a channel D, and discharging the air from an outlet E to the outside to reduce the bulkiness of the clothes, bedclothes or like article W. There is no likelihood that the outside air will flow into the bag through the opening B1 despite the lapse of time, permitting the bag to hold the article W compacted to a reduced size.

When the clothes, bedclothes or like article W enclosed is to be taken out of the closed bag B, the fasteners F are disengaged with fingers, while when the article W is to be enclosed again as sealed off, the slider 1 is slidingly moved in the opposite direction.

Although the slider 1 has been described above for use with a bag for enclosing a compressible article according to the above embodiment, the slider 1 is of course usable for other bags.

The preferred embodiment has been described above merely for illustrative purposes and should not be construed as limiting the invention. For example, the parallel grooves 5, 5 are formed in the inner surface of each plate 2*a*, whereas these grooves 5, 5 may be formed in only one of the plates 2*a*. Such modifications are all included within the scope of the invention unless they depart from the invention as defined in the appended claims.

What is claimed is:

1. An opening and closing system for a bag comprising:

an opening portion of the bag defined by opposed longitudinal edge portions, said longitudinal edge portions being integrally attached at each lateral end and each said longitudinal edge portion including longitudinally between said lateral ends a finger gripping outer section and an inner fastening section;

at least two fasteners provided one inside the other on said inner fastening sections of said opposed edge portions and below said finger gripping outer sections such that said finger gripping outer sections remain free when said fasteners are fastened, each said fastener including (a) a male fastener strip provided on an inner surface of one of said inner fastening sections of said edge portions, and (b) a female fastener strip provided on an inner surface of the other said inner fastening sections of said edge portion in opposed relation with said male strip; and a slider for engaging said at least two fasteners, said slider including (a) a slider body having a base portion, two opposite plates interconnected by said base portion and foldable over each other at said base portion, at least one of said plates being formed on an inner surface thereof with at least two grooves arranged in parallel for facing and fitting therein respective portions of said fasteners such that said plates press and engage said portions of said fasteners from outside, and a tongue-like stopper positioned inwardly of said plates and extending from said base portion to a position between said finger gripping outer sections but spaced from an adjacent said groove when said plates are folded over, and (b) a clamp member which holds said slider body on said opening portion with said plates folded over and with said respective portions of said fasteners held slidably in respective said grooves, and which said clamp member holds said tongue-like stopper between said opposed longitudinal edge portions thereby preventing said slider body and said clamp member from moving past each said integrally attached lateral end as said slider moves slidably along said longitudinal edge portions to seal said fasteners, which said sealed fasteners are subsequently opened by a user pulling apart the free said finger gripping outer sections.

2. An opening and closing system for a bag as claimed in claim 1:

wherein said clamp member of said slider includes a base portion, a first nipping piece extending integrally from said base portion, a second nipping piece extending integrally from said base portion in opposition to said first nipping piece and spaced apart therefrom by a distance such that free ends of said first and second nipping pieces form an open end, and respective first and second engaging projections extending toward one another from respective said free ends of said first and second nipping pieces; and wherein each of said two opposed plates of said slider body of said slider includes a furrow in an outer surface thereof which are engaged by respective said engaging projections of respective said first and second nipping pieces.

3. An opening and closing system for a bag as claimed in claim 2:

wherein an outer surface of each of said plates of said slider body includes at at least one side thereof a tapered face slanting outward; and wherein the free ends of said nipping pieces of said clamp member include at at least one side thereof a respective outward slanting triangular face so that said clamp member is slidingly fittable to said slider body with said triangular faces in contact with the respective said tapered faces.

4. An opening and closing system for a bag as claimed in claim 1:

wherein said slider body has said at least two grooves formed in the inner surface of each said plate symmetrically with respect to said base portion.

* * * * *